US006687916B2

(12) United States Patent
Thompson

(10) Patent No.: US 6,687,916 B2
(45) Date of Patent: Feb. 10, 2004

(54) DEFENSE BAND AND METHOD OF SELF DEFENSE

(76) Inventor: Greg Thompson, 2713 Cedar Creek Dr., Durham, NC (US) 27705

( * ) Notice: Subject to any disclaimer, the term of this patent is extended or adjusted under 35 U.S.C. 154(b) by 61 days.

(21) Appl. No.: 10/098,657

(22) Filed: Mar. 15, 2002

(65) Prior Publication Data

US 2003/0172436 A1 Sep. 18, 2003

(51) Int. Cl.[7] ..... A41D 20/00

(52) U.S. Cl. ..... 2/170; 2/16

(58) Field of Search ..... 2/311, 312, 336, 2/338, 321, 16, 17, 18, 19, 20, 908, 917, 161.4, 162, 170, 910, 919; D10/32; 24/70 J, 71 J, 265 WS, 906; 602/21, 64; 482/45, 44, 93

(56) References Cited

U.S. PATENT DOCUMENTS 3,536,068 A * 10/1970 Stubbs ..... 128/878
3,920,166 A * 11/1975 Hogensen, Jr. ..... 224/586
4,058,237 A * 11/1977 Luke ..... 222/78
4,135,645 A * 1/1979 Kimmell ..... 222/83
4,149,662 A * 4/1979 Ramaciere ..... 224/164
4,213,548 A * 7/1980 Wood ..... 224/168
4,242,715 A * 12/1980 Laird ..... 361/232
4,308,976 A * 1/1982 Speer et al. ..... 222/78
4,730,354 A * 3/1988 Saito ..... 2/161.2
5,087,220 A * 2/1992 Cotita ..... 446/247
5,137,176 A * 8/1992 Martineau et al. ..... 222/1
5,358,144 A * 10/1994 Mock ..... 222/78
5,367,714 A * 11/1994 Hines et al. ..... 2/311
5,593,073 A * 1/1997 Finnegan ..... 224/183
5,651,143 A * 7/1997 Zehrung ..... 2/338
5,745,920 A * 5/1998 Olivier ..... 2/170
5,749,841 A * 5/1998 Moore ..... 602/21
5,752,633 A * 5/1998 Antaki ..... 224/222
5,829,643 A * 11/1998 Isabella ..... 222/175
5,845,374 A * 12/1998 Briggs ..... 24/442
5,863,251 A * 1/1999 Fusco ..... 463/47.2
D408,988 S * 5/1999 Barber et al. ..... D3/215
5,921,949 A * 7/1999 Dray ..... 602/64
5,961,003 A * 10/1999 Coryell ..... 222/175
6,013,045 A * 1/2000 Gaylord ..... 602/64
6,049,905 A * 4/2000 Owens ..... 2/16
6,108,876 A * 8/2000 Hubbert ..... 24/265 WS
6,168,556 B1 * 1/2001 Saavedra ..... 482/93
6,179,177 B1 * 1/2001 Hihara et al. ..... 224/164
6,234,668 B1 * 5/2001 Cooper ..... 368/281
6,272,691 B1 * 8/2001 Henricksen et al. ..... 2/338
6,393,619 B1 * 5/2002 Bardes ..... 2/232
6,532,600 B2 * 3/2003 Brignoli ..... 2/311
6,545,193 B1 * 4/2003 Morgenstern ..... 602/41
6,546,603 B1 * 4/2003 Wang et al. ..... 24/451
6,564,385 B2 * 5/2003 McCarthy ..... 2/16

* cited by examiner

*Primary Examiner*—John J. Calvert
*Assistant Examiner*—Alissa L. Hoey
(74) *Attorney, Agent, or Firm*—Coats & Bennett, PLLC

(57) ABSTRACT

A band, including an extendable loop and worn around a user's arm, is used to apply a compressive force to an attacker's neck in self-defense. When the user positions the hand associated with the band against one side of the neck and grasps the extendable loop from the other side of the neck with the other hand, the user's arms become interconnected. This traps the attacker's neck between the user's interconnected arms and the extendable loop, and allows the user to apply a compressive force to the attacker's neck by simply extending the interconnected arms. The compressive force constricts the flow of blood in the carotid arteries that eventually incapacitate the attacker.

24 Claims, 5 Drawing Sheets

DEFENSE BAND AND METHOD OF SELF DEFENSE

BACKGROUND OF THE INVENTION

The present invention relates to the field of self-defense, and particularly to personal defense devices.

The world has become a dangerous place and, as a result, some people rely upon self-defense techniques to protect themselves. The success of these techniques depends on various factors, including the proximity of an attacker, training in self-defense (or the lack of it), the person's strength, and the size of an attacker.

For instance, a person may find kicking and punching techniques impractical if the attacker is in close proximity to the person, or if the attacker has a firm hold or grasp on the person. That same grasp may also serve to frustrate attempts at other more passive means of self-defense, such as mace or pepper spray, by prohibiting a person from reaching them. Additionally, many people simply may not have the physical strength needed to defend against an attacker that is stronger and larger than they are. What is needed is a readily available, self-defense device and method in which a person, regardless of training, amount of strength, or the proximity of the attacker, can neutralize the attacker.

SUMMARY OF THE INVENTION

The present invention comprises a self-defense device comprising a band including an extendable loop, worn around a user's arm and used to apply a compressive force to an attacker's neck. The user positions the hand associated with the band against the neck such that the extendable loop can be grasped from the opposite side of the neck with the user's free hand, thus interconnecting the user's arms and trapping the attacker's neck between the interconnected arms and the extendable loop. The user then applies a compressive force by extending or pivoting his or her arms while maintaining a firm grasp on the extendable loop.

In some embodiments of the present invention, a combination wristband and defense device is provided and includes a ring and a releasable fastener to secure the wristband to a user's wrist. Further, the wristband comprises segments that are joined or linked together, and includes a secondary strap that fastens across the segments to secure an optional object, such as a timepiece or a compass, to the wristband. An extendable loop is included and sized to receive at least one human digit, and preferably at least three human digits, and most preferably four human digits.

Further, the invention entails a method of self-defense using a wristband with an extendable loop. This method entails placing the outside of a hand associated with the wristband on one side of an attacker's neck and then reaching around with the other hand to grasp the extendable loop included with the wristband. This action interconnects the arms and traps the attacker's neck within the interconnected arms and the extendable loop. Subsequently extending the interconnected arms away from the body, while maintaining a firm grasp on the extendable loop, causes a compressive force or choking force to be applied to the attacker's neck. This compressive force constricts the flow of blood in the carotid arteries, thereby incapacitating the attacker.

DETAILED DESCRIPTION OF THE INVENTION

Figure 1:
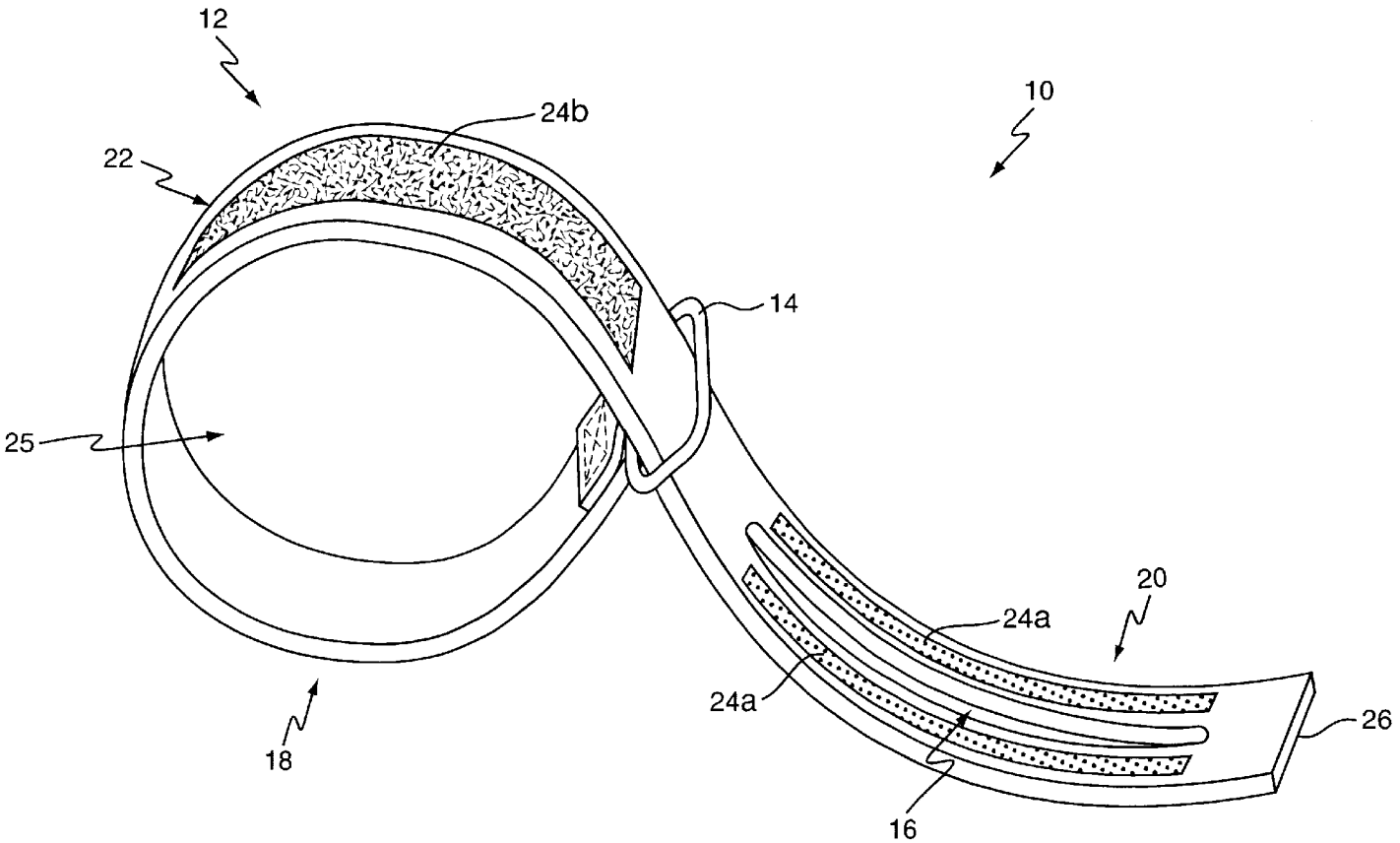
FIG. 1 is a perspective view of one embodiment of the present invention showing a continuous band with an extendable loop formed as a longitudinal slit.

Referring now to the drawings, FIG. 1 shows one embodiment of the defense device of the present invention, indicated generally by the number 10. The defense device 10 is comprised of a wristband 12 having a first end portion 18, a second end portion 20, and an intermediate portion 22. A first ring 14 is securely attached to the first end portion 18. An extendable loop 16 is formed in or by the second end portion 20. The extendable loop 16 is sized to receive at least one human digit, and preferably three human digits, and most preferably four human digits. In the embodiment of FIG. 1, the extendable loop 16 comprises a longitudinal slit in the second end portion 20.

A releasable fastener, generally referred to by the number 24 is provided to secure the extendable loop 16 to the intermediate portion 22 of the wristband 12. The fastener 24 includes a first part 24*a* secured to the second end portion 20 and a complementary second part 24*b* secured to the intermediate portion 22. As shown in FIG. 1, the first and second parts, 24*a* and 24*b*, may be cooperating portions of a hook-and-loop fastener. The first part 24*a* and the second part 24*b* are positioned such that, when aligned, they engage and are operable to secure the wristband 12 to a portion of a user's arm, preferably the wrist.

Figure 4:
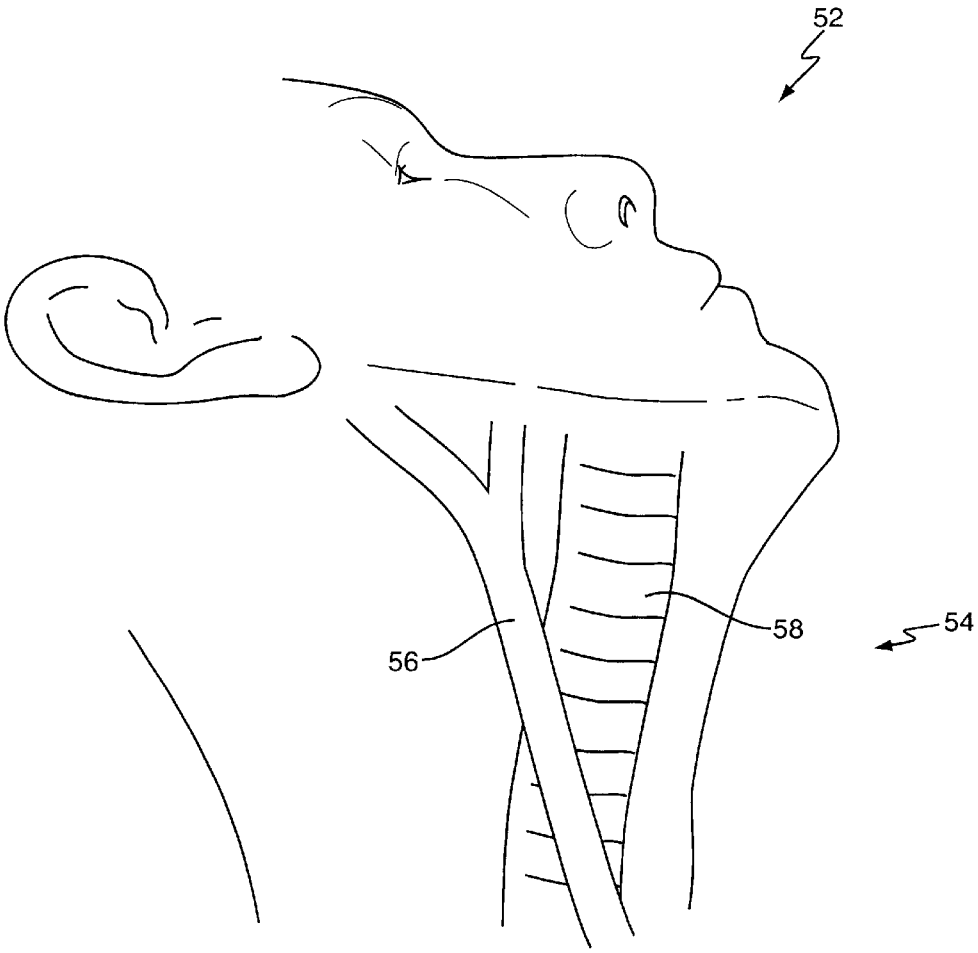
FIG. 4 is a partial side view of a potential attacker depicting the relative positions of a carotid artery and the larynx.

In use, the second end portion 20 inserts through ring 14 to form a loop 25 to receive a user's arm. The user inserts one arm through the loop 25 and tightens the wristband 12 around the arm by pulling the second end portion 20. The user, while maintaining tension on the second end portion 20, folds the second end portion 20 back against the intermediate portion 22 to engage the first and second parts 24*a* and 24*b*, of the releasable fastener 24. To deploy or extend the extendable loop 16, the user inserts one or more fingers through the extendable loop 16, and pulls it away from the intermediate portion 22. Grasping the extendable loop 16 interconnects the user's arms and enables the user to utilize the defense device 10 against an attacker 52 as shown in FIG. 4 and described more fully below.

Figure 2:
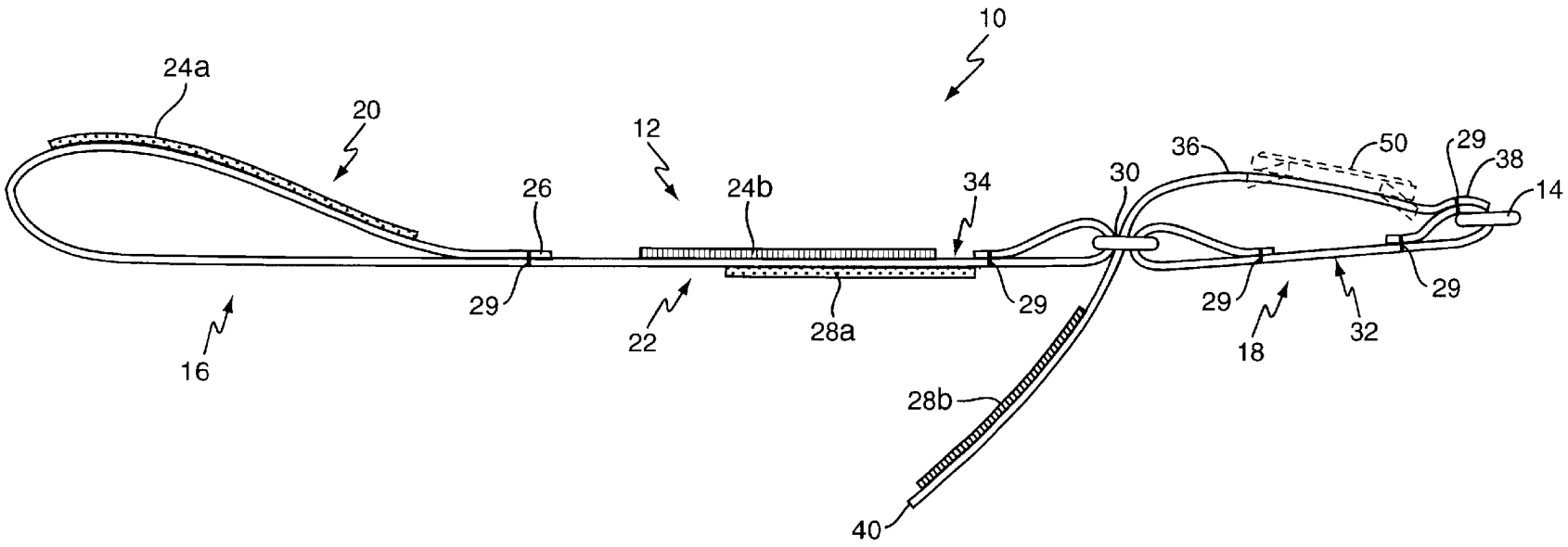
FIG. 2 is a side elevational view of another embodiment of the present invention showing a band comprised of multiple segments and an alternate method of forming the extendable loop.

FIG. 2 illustrates a second embodiment of the defense device 10 suitable for use as a watchband. In this embodiment, the wristband 12 is comprised of a first segment 32 and a second segment 34 joined by a second ring 30. A secondary strap 36 includes a fixed end 38 secured to the first end portion 18, and a free end 40. The free end 40 passes through some portion of an optional device 50, such as a timepiece 50 or a compass, before passing through a transverse slot 48 in ring 30 and fastening to the underside of the second segment 34 via fastener 28 (see FIGS. 3B and 3C). Here, the fastener, generally referred to by the number 28, is comprised of two complementary parts, 28*a* and 28*b*. It should be noted that although the fastener 28 is a hook and loop type fastener in this embodiment, it is by no means limited to this type of releasable fastener.

In the embodiment shown in FIG. 2, the extendable loop 16 is formed by folding the second end portion 20 back against itself and securing the terminal end 26, such as by stitching 29. As shown previously, the first part 24*a* and the second part 24*b* of the releasable fastener 24 are attached to the second end portion 20 and the intermediate portion 22 respectively.

The second embodiment securing this embodiment to the user's wrist is done in much the same way as previously discussed. Once the wristband 12 at least partially encircles the user's wrist, the second end portion 20, including the extendable loop 16, is passed through the first ring 14 and then tightened by pulling the second end portion 20. The user, while maintaining tension on the second end portion 20, folds the second end portion 20 back and wraps the second end portion 20 around the wrist. This aligns the first part 24*a* and the second part 24*b* of the releasable fastener 24, such that, when pressed together, they engage to secure the wristband 12 to the user's wrist. To deploy the extendable loop 16 the user inserts one or more fingers through the extendable loop 16 and pulls it away from the intermediate portion 22.

Figure 3A:
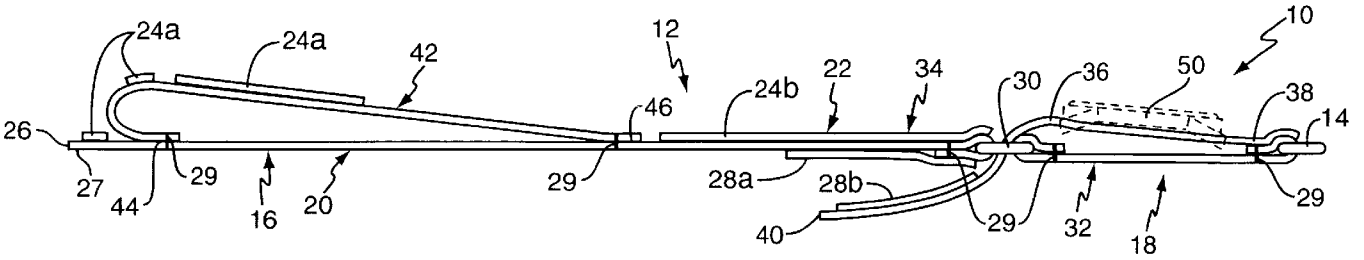
FIG. 3A is a side elevational view of yet another embodiment of the present invention with another method of forming the extendable loop.
Figure 3B:
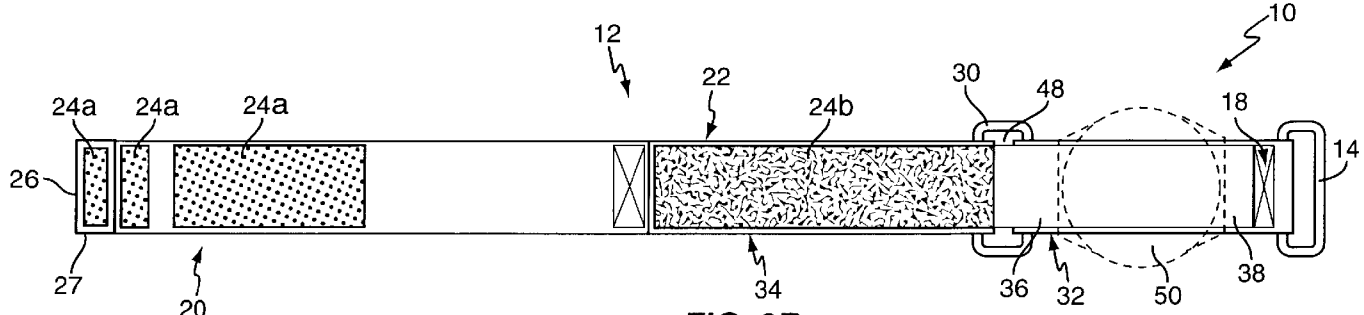
FIG. 3B is a top plan view of the embodiment depicted in FIG. 3A.
Figure 3C:
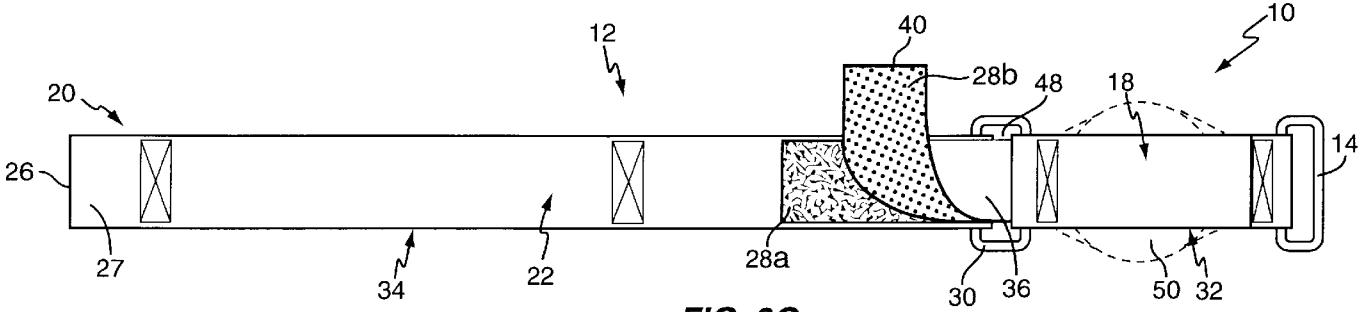
FIG. 3C is a bottom plan view of the embodiment depicted in FIG. 3A.

Another exemplary embodiment of the defense device 10 is depicted in FIG. 3A. In this embodiment, securing a first end 44 of a strap 42 to the second end portion 20, and a second end 46 to the intermediate portion 22 forms the extendable loop 16. The wristband 12 is again comprised of two segments; a second ring 30 joins the first segment 32 and the second segment 34. A secondary strap 36 is used to secure an alternate object, such as a timepiece 50, to the wristband 12 as shown in FIGS. 3A–3C. Here, to extend the extendable loop 16, the user simply grasps the extendable loop 16, and pulls it away from the intermediate portion 22.

Figure 5:
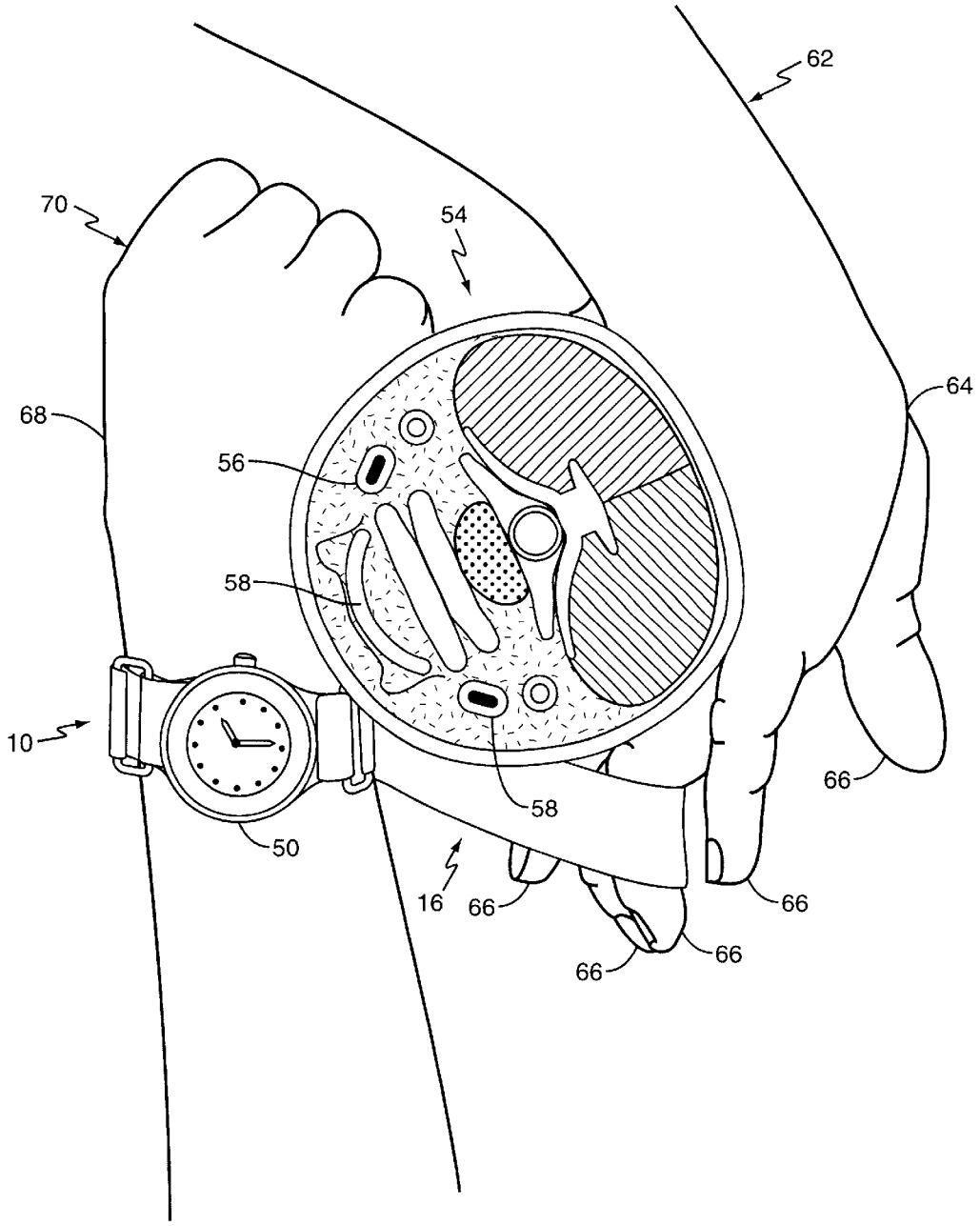
FIG. 5 is a top plan view of a method of use of one embodiment of the present invention showing positioning of a user's hands and the extendable loop relative to a cross-sectional portion of an attacker's neck.

FIGS. 4 and 5 illustrate how the defense device 10 is used to incapacitate an attacker 52 regardless of a size mismatch or personal ability or training. This is possible when the user utilizes the defense device 10 to apply a compressive force or choking force to an attacker's neck 54, specifically targeting the carotid arteries 56 and the larynx 58. One method used to apply this compressive force is depicted in FIG. 5. The user places the outside edge 70 of the hand 68 against the attacker's neck 54 generally in the area of at least one of the attacker's carotid arteries 56. The user then reaches around the attacker's neck 54 with the other arm 62 and inserts one or more digits through the extendable loop 16. Pulling on the extendable loop 16 separates the extendable loop 16 from the intermediate portion 22 of the wristband 12. This maneuver interconnects the user's arms 60 and 62 and traps the attacker's neck 54 within an area defined by the user's interconnected arms 60 and 62 and the extendable loop 16.

A compressive force can then be applied by the user to the attacker's neck 54 by pivoting or extending the user's arms 60 and 62 out and away from the user while maintaining a firm grasp on the extended loop 16 with hand 64. The compressive force compresses the carotid arteries 56 and the larynx 58 located in the attacker's neck 54, thereby constricting the flow of blood through the attacker's carotid arteries 56 and incapacitating the attacker 52.

Those skilled in the art will readily appreciate that the extendable loop 16 may be formed in any way known to the art, as long as it is sized to receive at least one human digit. It should also be noted that the first ring 14 and the second ring 30, depicted as "D-rings" in the illustrations, may also take various forms including, but not limited to, buckles, loops and transverse slits in the wristband 12 itself. The releasable fastener 24, is comprised of a first part 24*a* and a complimentary second part 24*b*. The first and second parts 24*a* and 24*b* may be attached such that they cover a substantial portion of the surfaces of the second end portion 20 and the intermediate portion 22. Likewise, first part 28*a* and second part 28*b* of fastener 28 may also be attached such that they cover a substantial portion of the secondary strap 36 and the underside of the segment 34. Additionally, the parts of releasable fastener 24 and fastener 28 may be attached using any method known in the art. Those skilled in the art will realize that although the hook-and-loop type fastener is depicted in the illustrations, the present invention is not limited solely to the use of hook and loop type fasteners. Alternate forms of fasteners include, but are not limited to, a snap or a plurality of snaps.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A combination wristband and defense device comprising:

a wristband having first and second end portions and an intermediate portion;

a releasable fastener having a first part and a second part, wherein the first part is attached to the second end portion, and wherein the second part is attached to the intermediate portion and engagable with the first part to secure the wristband to a users wrist;

wherein the second end portion folds back against the intermediate portion of the wristband such that the first and second parts of the releasable fastener engage; and an extendable loop formed in the second end portion sized to receive at least one human digit.

2. The device of claim 1 further comprising a first ring attached to the first end portion wherein the second end portion passes through the first ring.

3. The device of claim 2 wherein the wristband is comprised of at least two segments.

4. The device of claim 3 further comprising a second ring joining two adjacent segments of the wristband such that a transverse slot exists between the segments when the segments are attached to the second ring.

5. The device of claim 4 further comprising a secondary strap attached to the wristband for mounting a timepiece to the wristband.

6. The device of claim 5 wherein the secondary strap includes a fixed end and a free end, and wherein the fixed end is secured to the first end portion of the wristband, and wherein the free end is adapted to pass through the transverse slot in the second ring and fasten to the intermediate portion of the wristband.

7. The device of claim 1 wherein the loop is formed by folding the second end portion back against itself and securing a terminal end of the second end portion to the wristband.

8. The device of claim 1 wherein the loop is formed by a longitudinal slit in the wristband.

9. The device of claim 1 wherein the loop is formed by a strap having a first end secured adjacent a terminal end of the second end portion and a second end secured adjacent the intermediate portion.

10. The device of claim 1 wherein the releasable fastener is a hook and loop fastener.

11. The device of claim 1 wherein the releasable fastener is a snap fastener.

12. A self-defense device allowing a user to apply a compressive force, the device comprising:

a band securable to the user's first arm;

an extendable loop secured to the band and adapted to receive at least a portion of a hand on the other arm; and wherein when the user places a first hand of the first arm on one side of the attacker's neck and grasps the extendable loop with at least a portion of the other hand from the opposing side of the attacker's neck thereby trapping the attacker's neck between the user's interconnected arms and the extended loop, the user can apply a compressive force by pivoting the user's arms while maintaining a grasp on the extendable loop.

13. The device of claim 12 wherein the extendable loop is formed by folding a portion of the band back against itself and securing a terminal end of the portion to the band.

14. The device of claim 12 wherein the loop is formed by a longitudinal slit in the band.

15. The device of claim 12 wherein the loop is formed by a strap secured to the band.

16. The device of claim 12 wherein the band is further comprised of two or more segments.

17. The device of claim 16 further comprising a second ring operable to join the segments such that a transverse slot exists between the segments when the segments are attached to the second ring.

18. The device of claim 17 further comprising a secondary strap attached to the wristband for mounting an optional timepiece.

19. The device of claim 18 wherein the secondary strap includes a fixed end secured to the first end portion of the wristband, and a free end adapted to pass through the transverse slot in the second ring, and fasten to the underside of the adjacent segment.

20. A method of self-defense, the method comprising:

placing a user's first arm having a wristband with an extendable loop on a first side of an attacker's neck;

grasping the extendable loop with at least a portion of a hand on the user's other arm from the opposite side of the attacker's neck to trap the neck between the user's interconnected arms; and applying a compressive force to the attacker's neck by pivoting the user's arms while maintaining the grasp on the extendable loop.

21. The method of claim 20 wherein placing the first arm on a first side of a user's neck comprises positioning a hand associated with the user's first arm such that the outside edge of the hand presses against the attacker's neck generally in the area of at least one of the attacker's carotid arteries.

22. The method of claim 21 wherein grasping the extendable loop comprises reaching around the attacker's neck with the user's other arm and actuating a releasable fastener on the wristband such that the loop extends outwardly from the wristband.

23. The method of claim 22 wherein grasping the extendable loop further comprises interconnecting the user's arms by sliding at least a portion of the other hand into the extendable loop, thereby trapping the attacker's neck in an area defined by the user's interconnected arms and the extendable loop.

24. The method of claim 23 wherein applying compressive force comprises extending the user's arms away from the user's body while maintaining the grasp on the extendable loop such that the user's arms pivot around the attacker's neck, thereby constricting the flow of blood through the attacker's carotid arteries and incapacitating the attacker.

* * * * *